US006991010B1

(12) United States Patent
Smith

(10) Patent No.: US 6,991,010 B1
(45) Date of Patent: Jan. 31, 2006

(54) LOG SPLITTING HEAD FOR BUNDLEWOOD PRODUCTION

(76) Inventor: John R. Smith, 370 SE. 12th St., Pompano Beach, FL (US) 33060

( * ) Notice: Subject to any disclaimer, the term of this patent is extended or adjusted under 35 U.S.C. 154(b) by 0 days.

(21) Appl. No.: 11/133,733

(22) Filed: May 23, 2005

(51) Int. Cl.
*B27L 7/00* (2006.01)

(52) U.S. Cl. ..... 144/193.2; 144/195.8; 254/104

(58) Field of Classification Search ..... 144/193.1, 144/193.2, 195.4, 195.8, 195.1, 195.7, 195.9; 254/104
See application file for complete search history.

(56) References Cited

U.S. PATENT DOCUMENTS 4,353,401 A * 10/1982 Schilling ..... 144/195.1
4,421,149 A * 12/1983 Barnes et al. ..... 144/366
4,875,514 A * 10/1989 Hollister, Jr. ..... 144/367
5,957,175 A 9/1999 Smith
6,546,976 B1 * 4/2003 Hill ..... 144/195.1

* cited by examiner

*Primary Examiner*—Bena Miller
(74) *Attorney, Agent, or Firm*—Norman B. Rainer

(57) ABSTRACT

A splitting head for a log splitting apparatus includes abutting primary and secondary splitting assemblies, each having a circular securing ring that holds wedge members having cutting edges directed toward the log. The cutting edges of the secondary assembly split into smaller pieces the pieces produced by the primary assembly, producing a bundle of elongated pieces of firewood in parallel array and wherein the center of the bundle has not been compressed.

8 Claims, 2 Drawing Sheets

LOG SPLITTING HEAD FOR BUNDLEWOOD PRODUCTION

BACKGROUND OF THE INVENTION

1. Field of the Invention

This invention relates to apparatus for the splitting of wooden logs into small pieces useful as firewood.

2. Description of the Prior Art

Devices for converting logs into firewood generally employ a hydraulically driven ram-type mechanism which forces logs of pre-cut length into a stationary wedge having sharpened edges. As the log is axially advanced into the wedge, it splits into a plurality of sector-shaped pieces along cleavage lines that are generally directed radially with respect to the center axis and along medullar rays of the log. Typical examples of such devices are disclosed in U.S. Pat. Nos. 4,294,295; 4,353,401; 4,371,019; and 5,287,902.

In the production of firewood, there is considerable demand for "kindling" wood, namely pieces of firewood of small cross section which are easily ignited. The kindling wood, generally having a cross-sectional dimension less than about 3 inches, is further useful in small fireplaces or stoves or where there is no need for large, slow-burning logs to produce a substantial and prolonged thermal output. The kindling wood is also popular with elderly and disabled persons who cannot comfortably handle large firewood logs. For convenience and efficiency in marketing, the aforesaid kindling wood is generally sold in bundle form, secured by surrounding tying means such as string, wire, tape, or the like.

In order to produce split pieces of firewood of kindling size, a large number of pieces, generally between about 10 and 32 pieces, must be produced from logs commonly averaging 6" to 20" in diameter. Certain difficulties are encountered in seeking such result. If all the splitting is sought to be accomplished in a single pass through one splitting head, the requisite ram pressure would be extremely high, thereby necessitating equipment of high cost, large size and limited portability.

In order to produce a large number of split pieces without excessively high ram pressure, the use of multiple splitting heads has been disclosed, as in U.S. Pat. Nos. 5,957,175 and 4,353,401, wherein a primary splitting head precedes a subsequent axially spaced downstream splitting head which splits the initially produced pieces into still smaller pieces. However, the design and intent of the aforesaid multiple splitting heads is to cause all pieces to have a sector shape, namely a 3-sided shape wherein one side represents the outer curvature of the original log, and the other two sides are substantially flat, straight surfaces that converge to a tip representing the center of the original log. Such sector shape, in small dimensions, causes difficulties in stacking wood in a fireplace. Also, the very thin tips are very splintery, producing frequent jamming in the splitting heads, and further cause some handling discomfort to the user.

Accordingly, a primary object of the present invention is to provide a splitting head for a log splitting, apparatus for producing kindling wood.

It is another object of this invention to provide a splitting head as in the foregoing object wherein said kindling wood is readily amenable to bundling.

It is a further object of the present invention to provide a splitting head of the aforesaid nature capable of splitting a log into many pieces with relatively little requisite ram pressure.

It is a still further object of this invention to provide a splitting head of the aforesaid nature capable of producing kindling wood of non-sector configuration.

It is an additional object of the present invention to provide a splitting head of the aforesaid nature which is of rugged and simple design amenable to low cost manufacture.

These objects and other objects and advantages will be apparent from the following description.

SUMMARY OF THE INVENTION

The above and other beneficial objects and advantages are accomplished in accordance with the present invention by a multi-wedge splitting head for a log splitting apparatus equipped with a ram and guide means for axially advancing pre-cut logs in a substantially horizontal direction, said splitting head comprising:

a) a primary splitting assembly comprised of a first circular securing ring holding two diametrically extending wedge members intersecting at the center axis of said ring and having flat sides and forward cutting edges directed toward said ram, and b) a secondary splitting assembly positioned behind said primary splitting assembly in axial alignment therewith and comprised of a second circular securing ring of larger diameter than said first securing ring and embracing two sets of orthogonally intersecting wedge members producing a square aperture centered on the center of said second ring, said wedge members having flat sides and a forwardly directed cutting edges formed by way of a single bevel surface facing said ring.

In a preferred embodiment of the invention, banding means may be disposed adjacent the exit extremity of said splitting head to consolidate the numerous pieces of wood into a bundle of sufficient integrity to permit transportation and storage.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
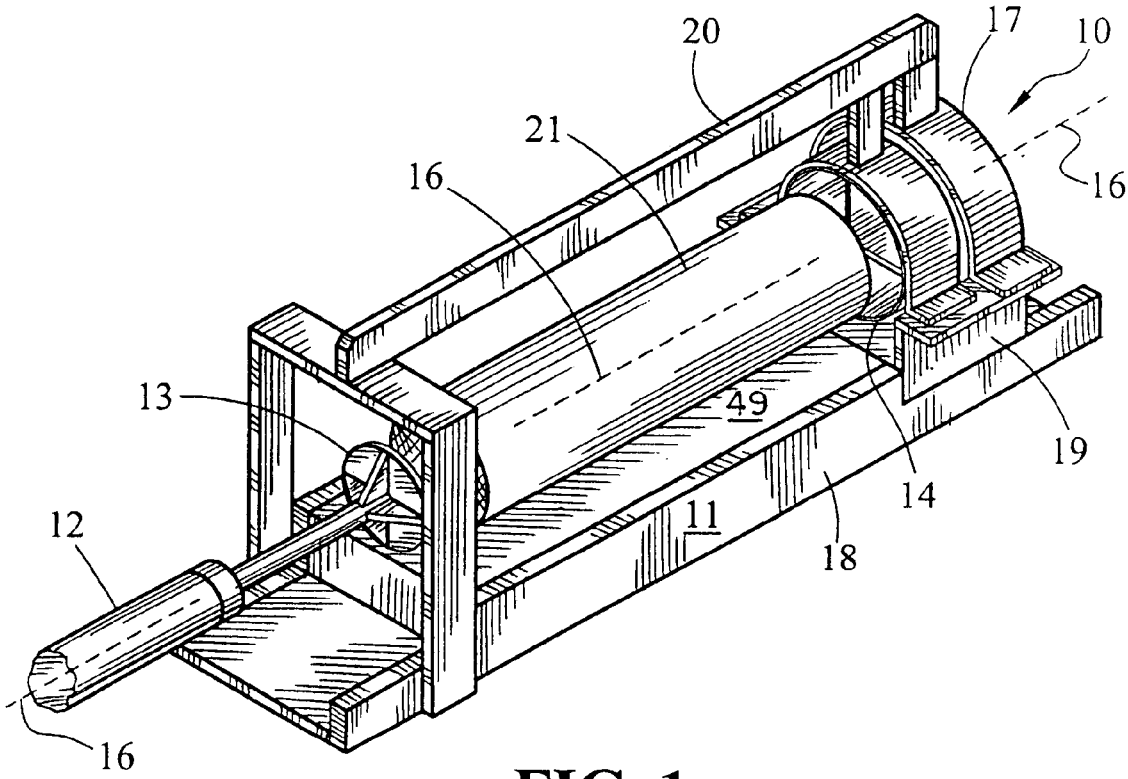
FIG. 1 is a side and rear perspective view of an embodiment of the splitting head of this invention, shown in association with a a log splitting apparatus of conventional design.
Figure 2:
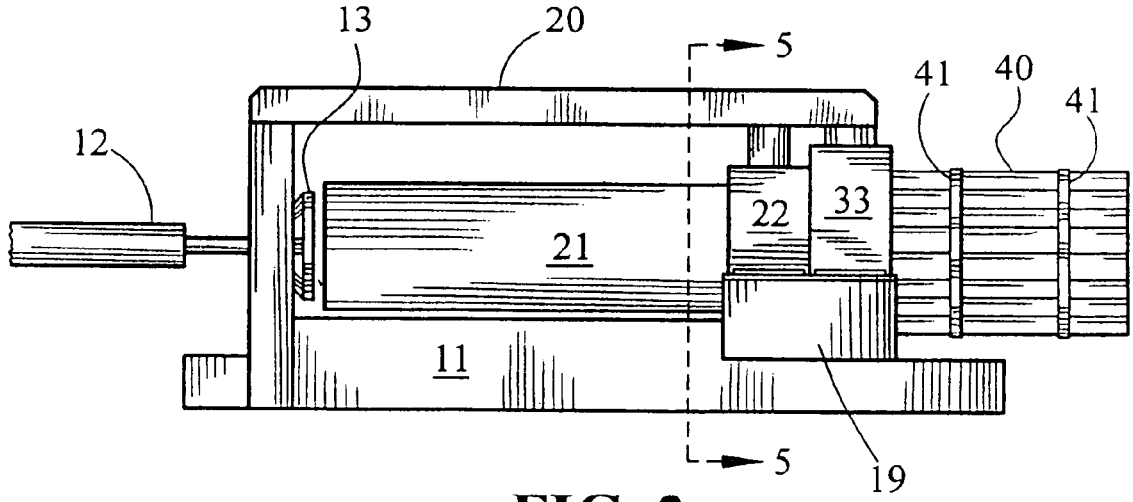
FIG. 2 is a side view of the embodiment of FIG. 1.
Figure 3:
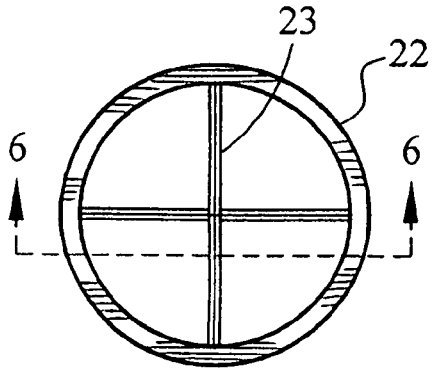
FIG. 3 is a front view of the primary splitting assembly of the embodiment of FIG. 1.
Figure 6:
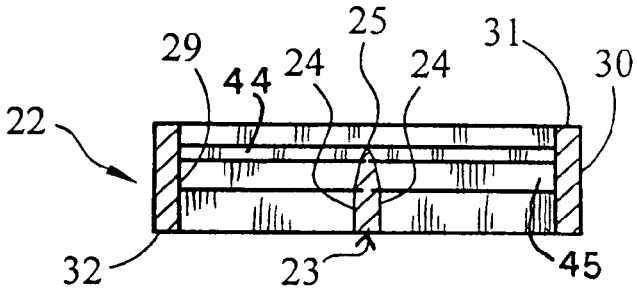
FIG. 6 is a sectional view taken in the direction of the arrows upon the line 6—6 of FIG. 3.
Figure 4:
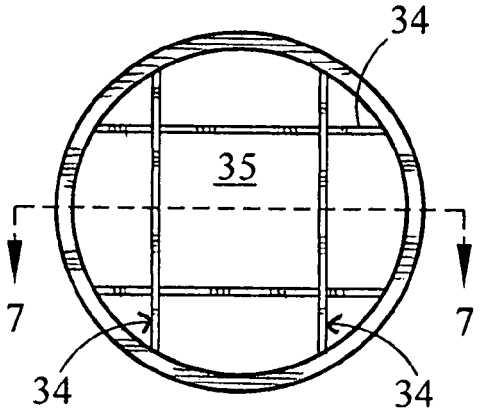
FIG. 4 is a front view of the secondary splitting assembly of the embodiment of FIG. 1.
Figure 7:
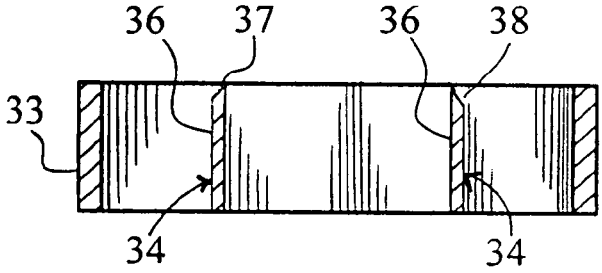
FIG. 7 is a sectional view taken in the direction of the arrows upon the line 7—7 of FIG. 4.

Referring now to FIGS. 1–7, an embodiment of the log splitting head 10 of the present invention is shown installed into a splitting apparatus having an elongated structural base 11, and a hydraulic ram 12 acting in the longitudinal direction of the base upon axis 16 and terminating in a pusher plate 13 which may be rotatable about the axis of the ram. Said ram is capable of exerting a force of between about 20 and 30 tons upon said logs.

Splitting head 10 is comprised of a primary splitting assembly 14 mounted in facing relationship with said pusher plate and in axial alignment therewith, and secondary splitting assembly 17 mounted rearwardly of assembly 14 and in contact therewith. Said assemblies are secured to base 11 by bottom, side and top structural members 18, 19 and 20, respectively. A log 21 readied for splitting is placed upon base 11 and advanced by ram 12 toward splitting head 10. Guiding track means 49 may be associated with base 11 to facilitate proper movement of the log.

Primary splitting assembly 14 is comprised of a first circular securing ring 22 bounded in part by leading and trailing circular edge surfaces, 31 and 32, respectively, and embracing two diametrically extending wedge members 23 intersecting orthogonally at the center of said ring. Wedge members 23 have flat sides 24 and a forward cutting edge 25 having a cutting angle of between about 18 and 22 degrees. Said cutting edge is preferably formed in association with contiguous leading and trailing bilaterally tapered surfaces 44 and 45, respectively, wherein the angle of convergence of said trailing surfaces is 8 to 12 degrees smaller than the angle of convergence of said leading surfaces. Such configuration of the wedge members at their cutting edges minimizes the force required by the ram to achieve splitting. Minimization of splitting force is a significant consideration in the apparatus of the present invention because of the large number of pieces produced in the splitting operation.

Figure 8:
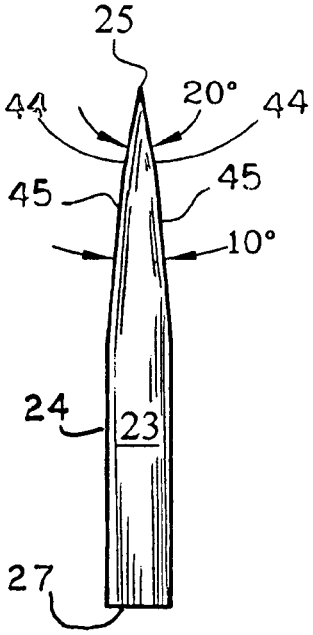
FIG. 8 is an enlarged fragmentary view of FIG. 6.

The thickness of wedges 23, measured between opposing sides 24, is preferably between about 0.50 and 0.75 inches as shown in FIG. 8. The width of wedges 23, measured between cutting edge 25 and rear end 27 is preferably shorter than the width of ring 22, and rear end 27 is coplanar with trailing circular edge surface 32. Such recessed nature of the wedges within the first ring enables logs to be properly seated within the ring before being forced against cutting edges 25.

Ring 22 may be further characterized as having interior and exterior surfaces 29 and 30, respectively. The inside diameter of ring 22 may range between 16 and 24 inches, and its thickness, measured between said interior and exterior surfaces, is preferably about one inch. Ring 22 and its wedges are preferably fabricated of alloy steel hardened to Rockwell 40–50.

Secondary splitting assembly 17 is comprised of a second circular securing ring 33 having a diameter between 12 and 15% larger than the corresponding diameter of ring 22, and axially aligned therewith. Securing ring 33 embraces two sets of orthogonally intersecting wedge members 34 which produce a square aperture 35 centered upon the center of ring 33.

Wedge members 34 are bounded in part by opposed flat sides 36, and have a forwardly directed cutting edge 37 having an angle between 20 and 24 degrees and formed by way of a single bevel surface 38 facing outwardly toward ring 33. Such cutting edge configuration reduces compression on central wood pieces i and D shown in FIG. 5. The thickness of wedge members 34 is between 0.50 and 0.75 inches, and ring 33 is of comparable thickness to ring 22. Said wedge members and ring are preferably constructed of the same grade of hardened alloy steel as the corresponding components of the primary splitting assembly.

Figure 5:
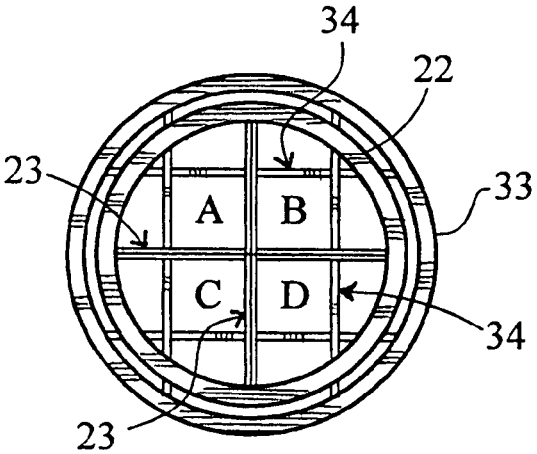
FIG. 5 is a sectional view taken in the direction of the arrows upon the line 5—5 of FIG. 2.

As shown in FIG. 5, the superimposed arrangement of the primary and secondary splitting assemblies causes a log to be split into 16 pieces, and none of such pieces have a sector cross-section. Said pieces emerge from the trailing, rear extremity of said secondary splitting assembly as parallel pieces in a loosly arranged bundle 40. Banding means 41, which may be string, rope, wire, tape or the like can then be applied manually or by separate mechanical means. A consolidated bundle is thereby produced wherein the separate pieces are easily removed and handled by virtue of their cross-sectional shapes and the fact that the central pieces have not been compressed. Additionally, the bundle may be employed in its entirety as a single log which will burn more quickly and with less smoke than the original log, the reason being that there is considerable air that is interactive with the interior region of the bundle.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A splitting head for a log splitting apparatus equipped with a ram and guide means for axially advancing pre-cut logs in a substantially horizontal direction, causing said log to be converted into numerous elongated pieces of firewood in parallel association, said splitting head comprising:

a) a primary splitting assembly comprised of a first circular securing ring holding two diametrically extending wedge members intersecting at the center of said ring and having flat sides and forward cutting edges directed toward said ram, and b) a secondary splitting assembly positioned behind said primary splitting assembly in axial alignment therewith and comprised of a second circular securing ring of larger diameter than said first securing ring and embracing two sets of orthogonally intersecting wedge members producing a square aperture centered upon the center of said second ring, said wedge members having flat sides and a forwardly directed cutting edge formed by way of a beveled surface facing said ring wherein said primary and secondary splitting assemblies are in contacting abutment.

2. The splitting head of claim 1 wherein the two wedge members of said primary splitting assembly intersect in an orthogonal manner.

3. The splitting head of claim 1 wherein each ring is bounded in part by leading and trailing circular edge extremities, said elongated pieces of firewood being emergent from the trailing edge extremity of said second securing ring.

4. The splitting head of claim 3 wherein said second securing ring has an inside diameter that is between 12% and 15% larger than the inside diameter of said first securing ring.

5. The splitting head of claim 4 configured to produce 16 pieces of elongated firewood, none of said pieces having a cross-sectional shape of a sector of the original log.

6. The splitting head of claim 4 wherein the cutting edges of the wedge members of said first securing ring have a cutting angle of between 18 and 22 degrees.

7. The splitting head of claim 6 wherein the cutting edges of the wedge members of said second securing ring have a cutting angle of between 20 and 24 degrees.

8. Apparatus comprising the splitting head of claim 3 in association with banding means disposed adjacent the trailing edge of said second securing ring for consolidating said numerous pieces of wood into a bundle of sufficient integrity to permit transportation and storage.

* * * * *